United States Patent [19]

Van Winkle

[11] Patent Number: 4,690,411

[45] Date of Patent: Sep. 1, 1987

[54] BONDED MECHANICALLY INNER CONNECTED SEAL ARRANGEMENT FOR A BLOWOUT PREVENTER

[76] Inventor: Denzal W. Van Winkle, P.O. Box 79727, Houston, Tex. 77279

[21] Appl. No.: 810,310

[22] Filed: Dec. 23, 1985

[51] Int. Cl.[4] ..... E21B 33/06; F16J 15/16

[52] U.S. Cl. ..... 277/166; 251/1.3; 277/126; 277/192; 277/228; 277/235 R

[58] Field of Search ..... 277/4, 73, 126, 127, 277/166, 227, 228, 235 R, 192, 199; 251/1.1, 1.2, 1.3; 52/309.11, 309.16; 166/82, 84, 85

[56] References Cited

U.S. PATENT DOCUMENTS

| | | | |
|---|---|---|---|
| 1,908,221 | 5/1933 | Church | 277/4 |
| 2,194,255 | 3/1940 | Allen | 277/73 |
| 3,102,709 | 9/1963 | Allen | 251/1.3 |
| 3,692,316 | 9/1972 | Bishop et al. | 277/73 |
| 3,772,129 | 11/1973 | Dover | 52/309.11 X |
| 3,897,038 | 7/1975 | Le Rouax | 251/1.2 |
| 4,398,729 | 8/1983 | Bishop et al. | 277/73 |
| 4,416,441 | 11/1983 | Van Winkle | 277/166 X |
| 4,447,038 | 5/1984 | Floyd | 251/1.2 |
| 4,467,996 | 8/1984 | Baugh | 251/1.3 |

FOREIGN PATENT DOCUMENTS

| | | | |
|---|---|---|---|
| 681312 | 10/1952 | United Kingdom | 277/73 |

*Primary Examiner*—Allan N. Shoap
*Attorney, Agent, or Firm*—Jack W. Hayden

[57] ABSTRACT

An expansible and contractable replaceable seal arrangement includes an elastomer body bonded to at least a pair of spaced, rigid plate members with a mechanical arrangement interconnecting the plate members and elastomer body to accommodate relative movement therebetween in response to expansion and contraction of the elastomer body bonded therewith and to inhibit separation of the plates and elastomer body.

6 Claims, 7 Drawing Figures

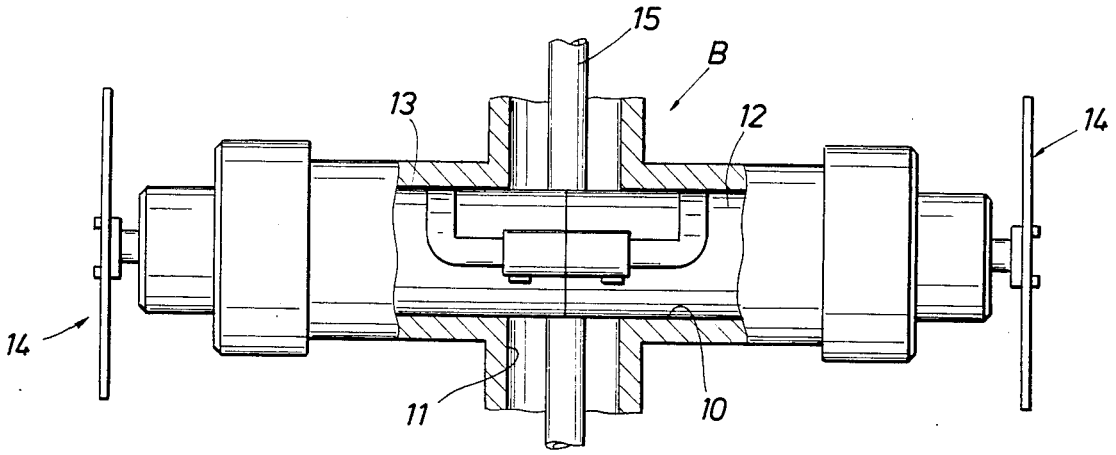
FIG. 1
FIG. 2
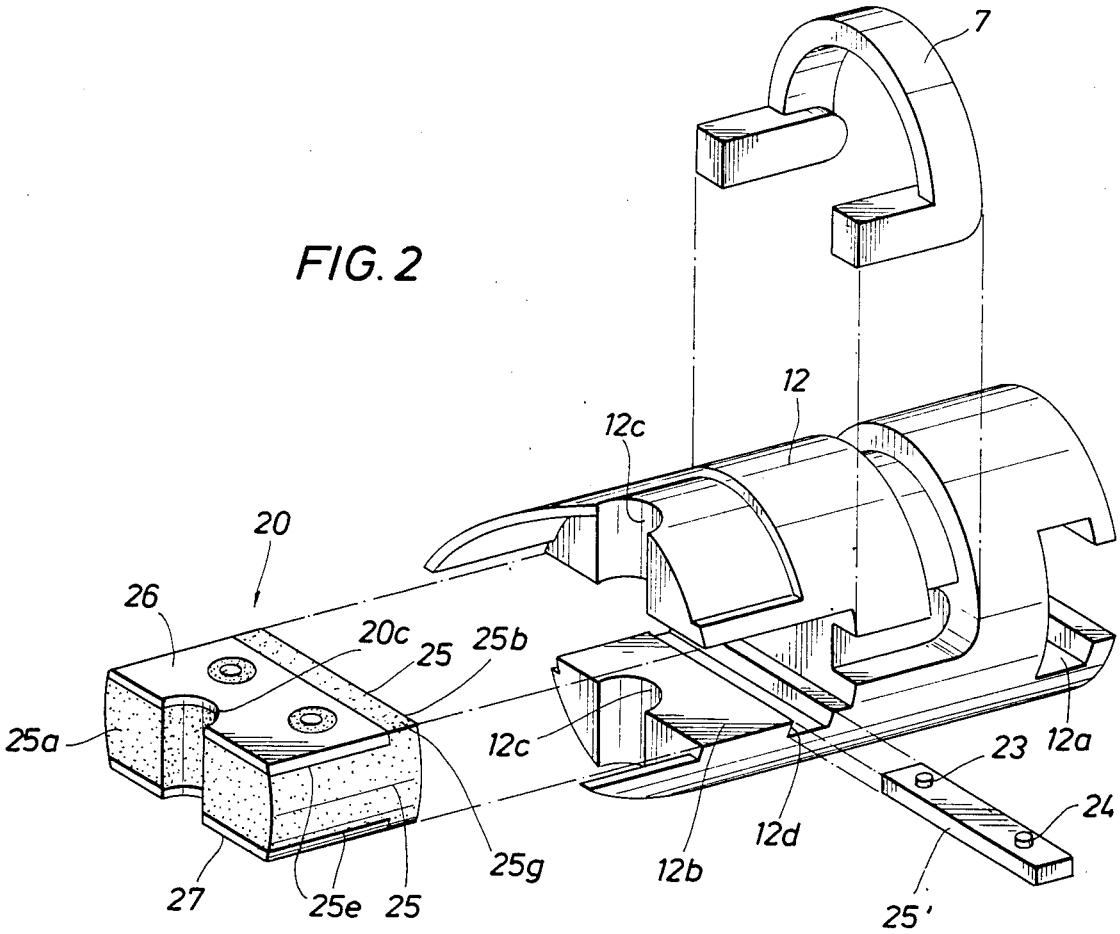

BONDED MECHANICALLY INNER CONNECTED SEAL ARRANGEMENT FOR A BLOWOUT PREVENTER

BACKGROUND OF THE INVENTION

Various seal arrangements have been provided for the groove which extends diametrically across the front of a blowout preventer ram body. One of such arrangements is demonstrated in U.S. Pat. No. 4,416,441 issued to applicant herein. As illustrated in such patent, the sealing arrangement includes an elastomer body which is metal reinforced, the metal being in the form of at least a pair of spaced plates which are intended to assist in positioning and retaining the seal arrangement in position in the groove that extends diametrically across the front of the blowout preventer ram body. Blowout preventer rams, and other seal arrangements in various type oil tools are employed in environments which tend to cause deterioation of the elastomer body. Also, the elastomer may become hard due to exposure to elements in the well fluid which come in contact with the seal arrangement.

Due to deterioation of the elastomer over a period of time, it is not uncommon for the elastomer body to lose its bond with the metal reinforcing plates and to either fall out or deterioate to such an extent that it falls out in response to pressure drop or other conditions that may occur in the well bore.

When this occurs, the rigid reinforcing plates may become lost in the well. Loss of the plates in the well may foul other devices in the well such as chokes, and cause other problems.

Also, during the molding of the elastomer with the metal plates, it first expands and then the rubber may shrink as it cures so that it tends to pull back away from the rigid reinforcing leaving less than a desirable product.

SUMMARY OF THE INVENTION

The present invention provides a sealing arrangement wherein an elastomer body is bonded to at least a pair of spaced rigid plate members and is mechanically locked in position between the plate members, which seal arrangement is constructed and arranged to allow expansion and contraction of the elastomer body and the metal reinforcing or plate members as a unit to inhibit separation of the plate members from the elastomer body bonded therewith. Also, the mechanical locking arrangement functions to assist in retaining the elastomer body in position should it become disconnected from the metal plates to avoid its loss in the well, and further the interconnecting arrangement assists in retaining the plates interlocked should the elastomer body become completely deterioated, or for other reasons lose its position between the plates.

The foregoing arrangement enables the seal arrangement to expand and contract during the molding process, and also accommodates expansion and contraction of the seal arrangement as a unit to accommodate changes in temperature or pressure in the environment in which it is employed, while retaining the elastomer body and reinforcing plates mechanically locked or connected, as well as assisting in maintaining the bond during the expansion and contraction of the seal arrangement and during use in varying pressures and temparatures.

Other objects and advantages of the present invention will become more readily apparent from a consideration of the following drawings and description.

BRIEF DESCRIPTION OF THE DRAWINGS

FIG. 1 is a side elevational view partly in section illustrating the position of the rams in a blowout preventer when moved in the transverse bores of the blowout preventer to close off communication in the longitudinal bore through the blowout preventer and seal within an elongate member extending through the longitudinal bore;

FIG. 2 is an exploded view illustrating one of the preventer rams and details of the seal arrangement of the present invention;

DESCRIPTION OF THE PREFERRED EMBODIMENTS

Figure 3:
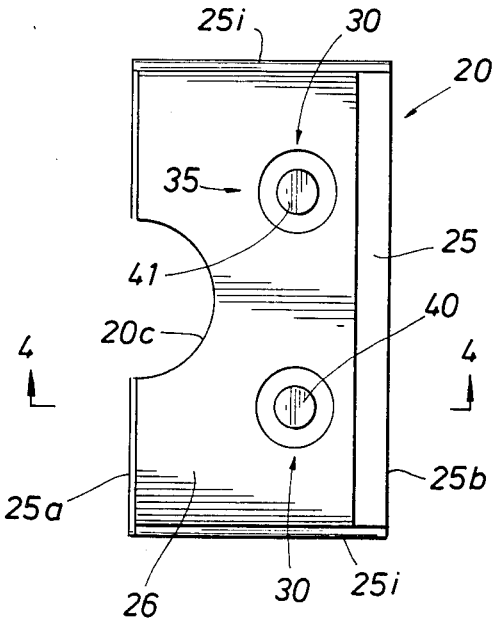
FIG. 3 is a top plan view illustrating the seal arrangement of the present invention in its embodiment for use in a blowout preventer ram body.

The present invention will be described in detail as it relates to its use in connection with a blowout preventer ram. However, such explanation is by way of example only and the seal arrangement of the present invention may be employed in any environment or situation where it has application.

In the drawings the blowout preventer is represented generally by the letter B in FIG. 1 and is shown as including a transverse bore 10 with a longitudinal bore 11. Rams 12 and 13 are mounted in the transverse bore 10 and are moved back and forth therein by any suitable means as illustrated generally at 14 for sealably engaging with the member 15 extending through the longitudinal bore 11. The ram is provided with a seal which, with the seal arrangement of the present invention seals the ram in bore 10. The general structure and function of a blowout preventer are well known to those skilled in the art as is the general construction of the rams 12 and 13.

In FIG. 2, one of the rams, such as the ram 12 is shown, the other ram 13 being of similar construction. It includes a generally cylindrical body having a suitable arrangement 12*a* to enable it to be operably connected with the moveable means 14, which moveable means 14 are construted in a manner well known to those skilled in the art for moving the ram to closed and open position.

A groove 12*b* extends diametrically across the front of the blowout preventer ram and is adapted to receive the seal arrangement 20 of the present invention. Further, the front end of each ram is provided with a recess that is contoured as illustrated at 12*c* to receive the member 15 to be sealably engaged.

Similarly the seal arrangement 20 is provided with a conforming recess contoured as shown at 20*c* to sealably engage and close off around the member 15 when the rams are moved to the position shown in FIG. 1.

The seal means 20 is releaseably retained in position in the groove 12*b* of the ram by means of spaced recesses 21 and 22 which are adapted to enage with the projections 23 and 24 on the retainer member 25', whereupon the assembled ram and retainer bar 25' may be moved laterally into the slot 12*d* formed in one of the opposing surfaces of the groove 12*b* to secure the seal arrangement 20 in position.

The seal arrangement of the present invention is illustrated in greater detail in FIGS. 3–6 and is shown as including an elastomer body 25 bonded to and between the spaced metal or rigid plates 26 and 27.

In the form of the seal arrangement described, the plates 26 and 27 are illustrated as extending from adjacent the front surface 25*a* of the elastomer body 25 and terminating at their rear edges in spaced relation to the rear surface 25*b* of the elastomer body 25. Further, the plates 26 and 27 are illustrated as being bonded to the elastomer body 25 within conforming recesses 25*e* formed in the top surface 25*g* and 25*h* of the elastomer body 25. The elastomer body 25 may be co-terminus with the termination of the sides of the plate members 26 and 27 or it may project therefrom where desired or necessary. For example, as better demonstrated in FIGS. 3, 5 and 5*a*, the edge surfaces of the elastomer body 25 between the plates 26 and 27 are arcuate and project therefrom to conform with the arcuate surface of the transverse bore 10 of the blowout preventer in which the form of the invention illustrated in the drawings is to be employed. The surfaces of body 25 may extend beyond metal plates 26 and 27 where desired to provide a better seal. It can be appreciated that this shape will change depending upon the use of the seal arrangement of the present invention.

A mechanical interlocking arrangement 30 is provided to interlock the elastomer body 25 with the rigid plate members 26 and 27, while still enabling the seal arrangement to expand and contract as a unit to assist in maintaining the bond between the elastomer body 25 and plates 26 and 27 and to assist in inhibiting dislodgement of the seal body as it deterioates or for other reasons, and to further assist in retaining the plates 26, 27 interlocked or in position to connect if the elastomer body should become totally displaced or dissipated. This arrangement inhibits any of the components of the seal arrangement of the present invention from dropping into the well bore and fouling other devices or tools therein.

Figure 5:
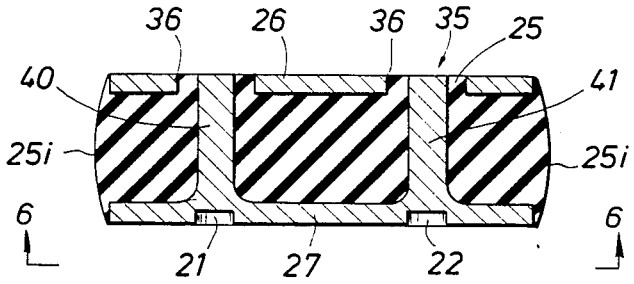
FIG. 5 is a sectional view on the line 5—5 of FIG. 4 to illustrate further details of the form shown in FIG. 4.
Figure 5A:
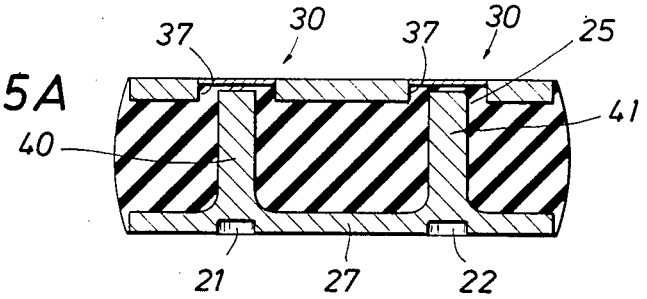
FIG. 5*a* is an alternate form of the mechanical locking arrangement.
Figure 6:
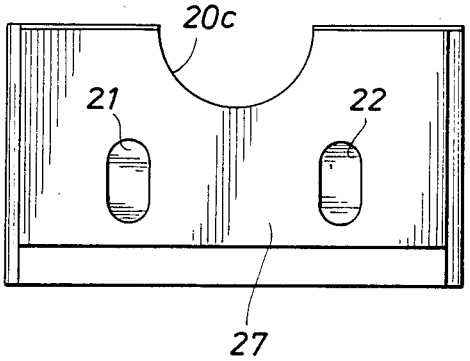
FIG. 6 is a bottom plan view on the line 6—6 of FIG. 5 to illustrate a portion of the releaseable retaining means for securing the seal arrangement of the present invention in position when used in a blowout preventer ram.

The interlocking arrangement 30 includes receptacle means referred to generally at 35, which receptacle means is shownin one form as being spaced openings formed in one of the plate members such as the plate member 26. In FIG. 5*a* the receptacle means 30 is shown as being in the form of a recess 37 which face the elastomer body 25, and in either form, the receptacle means 35 recevies the elastomer body 25 therein as illustrated in the drawings. The receptacle means 35 may be of any suitable configuration and arrangement and is illustrated as being circular since it is relatively easy to drill an opening through the plate 26, or provide a recess 37 therein.

Figure 4:
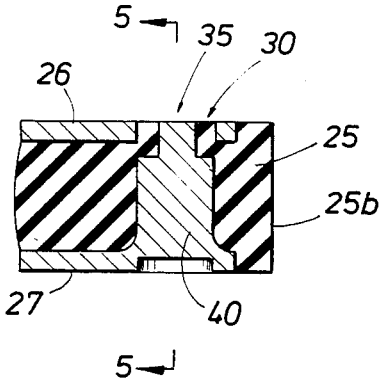
FIG. 4 is a sectional view on the line 4—4 of FIG. 3 and illustrates one form of the mechanical interlocking arrangement of the present invention.

Extending from the plate 27 and connected therewith are projection means in the form of posts 40 and 41 which extend into the elastomer which is also in receptacle means 35 as demonstrated in the drawings and which are surrounded by the elastomer body 25 as shown. The posts 40 and 41 may be of any suitable configuration and as illustrated in FIG. 4 are columns which may be integrally formed with the plate 27.

As a practical matter, the plates 26 and 27 with the posts 40 and 41 extending therebetween may be molded or cast as a unit, and then one of the plates disconnected by cutting or the like from the posts 40 and 41 and the receptacle means 35 formed therein in any suitable manner. The post ends may be also formed in any configuration to be received within receptacle means 35.

The recesses 37 are of suitable extent as is the opening 36 to accommodate relative movement of the elastomer body 25 due to engagement of the front of the seal with the member 15 or for any other reason, while retaining the units interconnected, but preferably enabling the plates 26 and 27 to remain disengaged or disconnected so as to assure proper relative movement therebetween and relative to body 25 during use.

This arrangement provides a seal arrangement that accommodates the necessary expansion and contraction of the elastomer body during the molding, or during use as well as relative movement between the components during use. It also inhibits separation of the plates 26 and 27 from the elastomer body during use, as such arrangement enables the plates 26 and 27 to move with the body 25 as a unit during any expansion or contraction and places them in a relationship to interconnect if the elastomer completely disappears.

It can also be appreciated that while the present invention has been described wherein only a pair of metal plates 26 and 27 are shown, a seal arrangement employing a plurality of interconnected plates throughout the elastomer body might be employed and mechanically interlock with the elastomer body 25 and with each other in the manner illustrated in the drawings.

Should the elastomer body dissipate through use or disappear, the mechanical interlocking arrangement tends to maintain the rigid plates 26 and 27 interconnected to avoid their displacement into the well bore.

While the plates 26 and 27 have been shown as being formed of metal, it can be appreciated that they may be formed of any suitable materials such as plastic or the like, so long as such substance is sufficiently rigid to accomplish the desired function of the sealing arrangement.

The foregoing disclosure and description are illustrative and explanatory of the invention, and various changes in the size, shape and materials as well as the details of the illustrated instructions may be made without departing from the spirit of the invention.

What is claimed is:

1. A replaceable seal arrangement for a groove extending diametrically across the front of a blowout preventer ram body comprising:

an elastomer body having upper and lower surfaces for fitting in the groove;

plate members embedded in the upper and lower surfaces of said elastomer body;

receptacle means in one of said plate members which includes said elastomer body therein;

projection means forming part of and extending from said other plate member, through said elastomer body and into the elastomer in said receptacle means for interlocking said plate members together without securing said projection means to said one plate member to accommodate relative movement of said interlocked plate members upon expansion and contraction of said seal means, said receptacle means and elastomer body therein being significantly larger than the portion of the projection means received therein about the entire periphery of said portion to accommodate said relative movement; and releasable means for releasably securing said seal arrangement in the groove of the ram body.

2. The seal arrangement of claim 1 wherein said receptacle means comprises longitudinally spaced recesses in said one plate means, and wherein said releaseable means includes a slot extending transversely of the groove in the ram body, spaced recesses in the plate member facing the slot in the groove, and a retainer for fitting in the slot and having spaced projections therein for receiving the recesses in the plate member whereby said seal arrangement and retainer may be interconnected and secured in position in the groove.

3. The seal arrangement of claim 1 wherein said receptacle means comprises longitudinally spaced openings in said one plate means, and wherein said releaseable means includes a slot extending laterally of the groove in the ram body, spaced recesses in the plate member facing the slot in the groove, and a retainer for fitting in the slot and having spaced projections therein for receiving the recesses in the plate member whereby said seal arrangement and retainer may be interconnected and secured in position in the groove.

4. An expansible and contractable seal arrangement for a groove extending diametrically across the front of a blowout preventer ram body comprising;

an elastomer body bonded to at least a pair of spaced plate members; and mechanical means interlocking said plate members and elastomer body to accommodate relative movement therebetween in response to expansion and contraction of said elastomer body bonded therewith while maintaining said plate members interlocked;

said mechanical means including receptacle means in one of said plate members in which said elastomer body extends; and projection means forming part of and extending from said other plate member through said elastomer body and into said receptacle means for interlocking said plate members together without securing said projection means to said one plate member to accommodate relative movement of said plate members upon expansion and contraction of said seal means, said receptacle means and elastomer body therein being significantly larger than the portion of the projection means received therein about the entire periphery of said portion to accommodate said relative movement.

5. The seal arrangement of claim 4 wherein said receptacle means comprises longitudinally spaced recesses in said one plate means, and wherein said releaseable means includes a slot extending transversely of the groove in the ram body, spaced recesses in the plate member facing the slot in the groove, and a retainer for fitting in the slot and having spaced projections therein for receiving the recesses in the plate member whereby said seal arrangement and retainer may be interconnected and secured in position in the groove.

6. The seal arrangement of claim 4 wherein said receptacle means comprises longitudinally spaced openings in said one plate means, and wherein said releaseable means includes a slot extending transversely of the groove in the ram body, spaced recesses in the plate member facing the slot in the groove, and a retainer for fitting in the slot and having spaced projections therein for receiving the recesses in the plate member whereby said seal arrangement and retainer may be interconnected and secured in position in the groove.

* * * * *